US009053846B2

(12) United States Patent
Ozeki et al.

(10) Patent No.: US 9,053,846 B2
(45) Date of Patent: Jun. 9, 2015

(54) PERMANENT MAGNET AND MANUFACTURING METHOD THEREOF

(75) Inventors: Izumi Ozeki, Ibaraki (JP); Katsuya Kume, Ibaraki (JP); Keisuke Hirano, Ibaraki (JP); Tomohiro Omure, Ibaraki (JP); Keisuke Taihaku, Ibaraki (JP); Takashi Ozaki, Ibaraki (JP)

(73) Assignee: NITTO DENKO CORPORATION, Osaka (JP)

( * ) Notice: Subject to any disclaimer, the term of this patent is extended or adjusted under 35 U.S.C. 154(b) by 155 days.

(21) Appl. No.: 13/499,338

(22) PCT Filed: Mar. 28, 2011

(86) PCT No.: PCT/JP2011/057572

§ 371 (c)(1), (2), (4) Date: Mar. 30, 2012

(87) PCT Pub. No.: WO2011/125591

PCT Pub. Date: Oct. 13, 2011

(65) Prior Publication Data

US 2012/0181475 A1 Jul. 19, 2012

(30) Foreign Application Priority Data

Mar. 31, 2010 (JP) ..... 2010-084206

(51) Int. Cl.

| | |
|---|---|
| ***H01F 1/057*** | (2006.01) |
| ***H01F 1/08*** | (2006.01) |
| H01F 41/02 | (2006.01) |
| ***C22C 38/00*** | (2006.01) |
| ***C22C 33/02*** | (2006.01) |
| *B22F 9/04* | (2006.01) |

(Continued)

(52) U.S. Cl.

CPC ..... *H01F 1/086* (2013.01); *H01F 1/0572* (2013.01); *H01F 1/0577* (2013.01);

(Continued)

(58) Field of Classification Search

CPC ..... H01F 1/0572; H01F 1/0577; H01F 1/086
USPC ..... 252/62.51 R, 62.55; 335/302; 148/101; 419/19, 44

See application file for complete search history.

(56) References Cited

U.S. PATENT DOCUMENTS 7,824,506 B2 * 11/2010 Machida et al. ..... 148/122
2005/0133117 A1 6/2005 Tayu et al.

(Continued)

FOREIGN PATENT DOCUMENTS

CN 101031984 A 9/2007
JP 7-263265 A 10/1995

(Continued)

OTHER PUBLICATIONS

Supplementary European Search Report issued in Application No. 11765491.3 dated Oct. 10, 2012.

(Continued)

*Primary Examiner* — Matthew E Hoban
(74) *Attorney, Agent, or Firm* — Sughrue Mion, PLLC

(57) ABSTRACT

There are provided a permanent magnet and a manufacturing method thereof enabling carbon content contained in magnet particles to be reduced in advance before sintering even when wet milling is employed. Coarsely-milled magnet powder is further milled by a bead mill in a solvent together with an organometallic compound expressed with a structural formula of $M-(OR)_x$ (M includes at least one of neodymium, praseodymium, dysprosium and terbium, each being a rare earth element, R represents a substituent group consisting of a straight-chain or branched-chain hydrocarbon, x represents an arbitrary integer) so as to uniformly adhere the organometallic compound to particle surfaces of the magnet powder. Thereafter, a compact body of compacted magnet powder is held for several hours in hydrogen atmosphere at 200 through 900 degrees Celsius to perform hydrogen calcination process. Thereafter, through sintering process, a permanent magnet 1 is manufactured.

3 Claims, 13 Drawing Sheets

(52) U.S. Cl.
CPC ..... *H01F 41/0266* (2013.01); *H01F 41/0293* (2013.01); *C22C 38/002* (2013.01); *C22C 33/0278* (2013.01); *B22F 2009/042* (2013.01); *B22F 2998/10* (2013.01); *B22F 2999/00* (2013.01)

(56) References Cited

U.S. PATENT DOCUMENTS

| | | | | |
|---|---|---|---|---|
| 2009/0053094 | A1 | 2/2009 | Morimoto et al. | |
| 2010/0129538 | A1 * | 5/2010 | Kunieda et al. ..... | 427/127 |

FOREIGN PATENT DOCUMENTS

| | | | | |
|---|---|---|---|---|
| JP | 10-64746 | A | | 3/1998 |
| JP | 3298219 | B2 | | 4/2002 |
| JP | 2005-191187 | | * | 7/2005 |
| JP | 2005-191187 | A | | 7/2005 |
| JP | 2006-270087 | A | | 10/2006 |
| JP | 2007-134417 | A | | 5/2007 |
| JP | 2009-259956 | A | | 11/2009 |
| WO | 2009/116532 | A1 | | 9/2009 |

OTHER PUBLICATIONS

International Search Report (PCT/ISA/210) issued by the International Searching Authority in corresponding International Application No. PCT/JP2011/057572.

Notification of Ground for Rejection issued in JP 2011-069702 dated Nov. 8, 2011.

Notification of First Office Action issued by the State Intellectual Property Office of P.R. China in counterpart CN Application No. 201180003981.X dated Oct. 24, 2012.

* cited by examiner

FIG. 6

| | M | OR | CALCINATION | CARBON CONTENT (wt%) |
|---|---|---|---|---|
| EMBODIMENT 1 | Dy | n-PROPOXIDE | YES | 0.17 |
| EMBODIMENT 2 | Dy | ETHOXIDE | YES | 0.16 |
| EMBODIMENT 3 | Tb | ETHOXIDE | YES | 0.16 |
| COMPARATIVE EXAMPLE 1 | Dy | n-PROPOXIDE | NO | 0.20 |
| COMPARATIVE EXAMPLE 2 | Tb | ETHOXIDE | NO | 0.27 |
| COMPARATIVE EXAMPLE 3 | Dy | ACETYLACETONATE | YES | 0.28 |

ADDITIVE M-(OR)x

EMBODIMENT 1

EMBODIMENT 2

EMBODIMENT 3

EMBODIMENT 3

COMPARATIVE EXAMPLE 1

COMPARATIVE EXAMPLE 2

COMPARATIVE EXAMPLE 3

PERMANENT MAGNET AND MANUFACTURING METHOD THEREOF

CROSS REFERENCE TO RELATED APPLICATIONS

This application is a National Stage of International Application No. PCT/JP2011/057572 filed Mar. 28, 2011, claiming priority based on Japanese Patent Application No. 2010-084206 filed Mar. 31, 2010, the contents of all of which are incorporated herein by reference in their entirety.

TECHNICAL FIELD

The present invention relates to a permanent magnet and manufacturing method thereof.

BACKGROUND ART

In recent years, a decrease in size and weight, an increase in power output and an increase in efficiency have been required in a permanent magnet motor used in a hybrid car, a hard disk drive, or the like. To realize such a decrease in size and weight, an increase in power output and an increase in efficiency in the permanent magnet motor mentioned above, a further improvement in magnetic performance is required of a permanent magnet to be buried in the permanent magnet motor. Meanwhile, as permanent magnet, there have been known ferrite magnets, Sm—Co-based magnets, Nd—Fe—B-based magnets, $Sm_2Fe_{17}N_x$-based magnets or the like. As permanent magnet for permanent magnet motor, there are typically used Nd—Fe—B-based magnets among them due to remarkably high residual magnetic flux density.

As method for manufacturing a permanent magnet, a powder sintering process is generally used. In this powder sintering process, raw material is coarsely milled first and furthermore, is finely milled into magnet powder by a jet mill (dry-milling method) or a wet bead mill (wet-milling method). Thereafter, the magnet powder is put in a mold and pressed to form in a desired shape with magnetic field applied from outside. Then, the magnet powder formed and solidified in the desired shape is sintered at a predetermined temperature (for instance, at a temperature between 800 and 1150 degrees Celsius for the case of Nd—Fe—B-based magnet) for completion.

PRIOR ART DOCUMENT

Patent Document

Patent document 1: Japanese Registered Patent Publication No. 3298219 (pages 4 and 5)

DISCLOSURE OF THE INVENTION

Problem to Be Solved by the Invention

Furthermore, magnetic properties of a permanent magnet can be improved through making the composition thereof closer to the stoichiometric composition (in a case of Nd—Fe—B-based magnets, $Nd_2Fe_{14}B$). Accordingly, the amount of each component of magnet raw material when manufacturing a permanent magnet is conventionally set to be the amount based upon a stoichiometric composition (for example, Nd: 26.7 wt %, Fe (electrolytic iron): 72.3 wt %, B: 1.0 wt %).

An example of problems likely to rise when manufacturing the Nd—Fe—B-based magnet is formation of alpha iron in a sintered alloy. This may be caused as follows: when a permanent magnet is manufactured using a magnet raw material alloy whose contents are based on the stoichiometric composition, rare earth elements therein combine with oxygen during the manufacturing process so that the amount of rare earth elements becomes insufficient in comparison with the stoichiometric composition. Further, if alpha iron remains in the magnet after sintering, the magnetic property of the magnet is degraded.

Then, a conceivable method is to increase the amount of rare earth elements contained in the magnet raw material in advance to be larger than the amount based on the stoichiometric composition. However, with such a method, the magnet composition after milling the magnet raw material varies greatly, thus it becomes necessary to recompose the magnet composition after milling.

Meanwhile, it has been known that the magnetic performance of a permanent magnet can be basically improved by making the crystal grain size in a sintered body very fine, because the magnetic characteristics of a magnet can be approximated by a theory of single-domain particles. Here, in order to make the grain size in the sintered body very fine, a particle size of the magnet raw material before sintering also needs to be made very fine.

Here, the milling methods to be employed at the milling of the magnet raw material include wet bead milling, in which a container is rotated with beads (media) put therein, and slurry of the magnet raw material mixed in a solvent is added into the container, so that the magnet raw material is ground and milled. The wet bead milling allows the magnet raw material to be milled into a range of fine particle size (for instance, 0.1 μm through 5.0 μm).

However, in a wet milling method like the above wet bead milling, an organic solvent such as toluene, cyclohexane, ethyl acetate and methanol may be used as a solvent to be mixed with the magnet raw material. Accordingly, even if the organic solvent is volatilized through vacuum desiccation or the like after milling, carbon-containing material may remain in the magnet. Then, reactivity of Nd and carbon is significantly high and carbide is formed in case carbon-containing material remains even at a high-temperature stage in a sintering process. Consequently, there has been such a problem as thus formed carbide causes a gap between a main phase and a grain boundary phase, so that the entirety of the magnet cannot be sintered densely, drastically degrading magnetic performance thereof. Even if no gap is formed, there still be a problem that the formed carbide causes alpha iron to separate out in a main phase of a sintered magnet and magnetic properties are considerably degraded.

The invention has been made in order to solve the above-mentioned conventional problems, and an object of the invention is to provide a permanent magnet in which the magnet powder mixed with the organic solvent at the wet milling is calcined in a hydrogen atmosphere before sintering so that the amount of carbon contained in a magnet particle can be reduced in advance, and at the same time, even if rare earth elements are combined with oxygen or carbon during a manufacturing process, the rare earth elements do not become insufficient in comparison with the stoichiometric composition, so that the formation of alpha iron in the sintered permanent magnet can be inhibited, allowing the improvement of the magnetic properties thereof; and a method for manufacturing the permanent magnet.

Means for Solving the Problem

To achieve the above object, the present invention provides a permanent magnet manufactured through steps of: wet-milling magnet material in an organic solvent together with an organometallic compound expressed with a structural formula of M–(OR)$_x$ (M including at least one of neodymium, praseodymium, dysprosium and terbium, each being a rare earth element, R representing a substituent group consisting of a straight-chain or branched-chain hydrocarbon, and x representing an arbitrary integer) to obtain magnet powder of the magnet material currently milled and to make the organometallic compound adhered to particle surfaces of the magnet powder; compacting the magnet powder having the organometallic compound adhered to particle surfaces thereof so as to form a compact body; calcining the compact body in hydrogen atmosphere so as to obtain a calcined body; and sintering the calcined body.

To achieve the above object, the present invention further provides a permanent magnet manufactured through steps of: wet-milling magnet material in an organic solvent together with an organometallic compound expressed with a structural formula of M–(OR)$_x$ (M including at least one of neodymium, praseodymium, dysprosium and terbium, each being a rare earth element, R representing a substituent group consisting of a straight-chain or branched-chain hydrocarbon, and x representing an arbitrary integer) to obtain magnet powder of the magnet material currently milled and to make the organometallic compound adhered to particle surfaces of the magnet powder; calcining the magnet powder having the organometallic compound adhered to particle surfaces thereof in hydrogen atmosphere so as to obtain a calcined body; compacting the calcined body so as to form a compact body; and sintering the compact body.

In the above-described permanent magnet of the present invention, metal contained in the organometallic compound is concentrated in grain boundaries of the permanent magnet after sintering.

In the above-described permanent magnet of the present invention, R in the structural formula is an alkyl group.

In the above-described permanent magnet of the present invention, R in the structural formula is an alkyl group of which carbon number is any one of integer numbers 2 through 6.

In the above-described permanent magnet of the present invention, residual carbon content after sintering is under 0.2 wt %.

To achieve the above object, the present invention further provides a manufacturing method of a permanent magnet comprising steps of wet-milling magnet material in an organic solvent together with an organometallic compound expressed with a structural formula of M–(OR)$_x$ (M including at least one of neodymium, praseodymium, dysprosium and terbium, each being a rare earth element, R representing a substituent group consisting of a straight-chain or branched-chain hydrocarbon, and x representing an arbitrary integer) to obtain magnet powder of the magnet material currently milled and to make the organometallic compound adhered to particle surfaces of the magnet powder; compacting the magnet powder having the organometallic compound adhered to particle surfaces thereof so as to form a compact body; calcining the compact body in hydrogen atmosphere so as to obtain a calcined body; and sintering the calcined body.

To achieve the above object, the present invention further provides a manufacturing method of a permanent magnet comprising steps of: wet-milling magnet material in an organic solvent together with an organometallic compound expressed with a structural formula of M–(OR)$_x$ (M including at least one of neodymium, praseodymium, dysprosium and terbium, each being a rare earth element, R representing a substituent group consisting of a straight-chain or branched-chain hydrocarbon, and x representing an arbitrary integer) to obtain magnet powder of the magnet material currently milled and to make the organometallic compound adhered to particle surfaces of the magnet powder; calcining the magnet powder having the organometallic compound adhered to particle surfaces thereof in hydrogen atmosphere so as to obtain a calcined body; compacting the calcined body so as to form a compact body; and sintering the compact body.

In the above-described manufacturing method of permanent magnet of the present invention, R in the structural formula is an alkyl group.

In the above-described manufacturing method of permanent magnet of the present invention, R in the structural formula is an alkyl group of which carbon number is any one of integer numbers 2 through 6.

Effect of the Invention

According to the permanent magnet of the present invention having the above configuration, at the wet milling which is a manufacturing process of the permanent magnet, magnet powder is mixed with organic solvent and compacted to form a compact body, which is calcined in a hydrogen atmosphere before sintering, so that the amount of carbon contained in a magnet particle can be reduced in advance. Consequently, the entirety of the magnet can be sintered densely without making a gap between a main phase and a grain boundary phase in the sintered magnet, and decline of coercive force can be avoided. Further, considerable amount of alpha iron does not separate out in the main phase of the sintered magnet and serious deterioration of magnetic properties can be avoided.

Further, according to the permanent magnet of the present invention, even if rare earth elements are combined with oxygen or carbon during a manufacturing process, the rare earth elements do not become insufficient in comparison with the stoichiometric composition, so that the formation of alpha iron in the sintered permanent magnet can be inhibited. Further, the magnet composition does not vary greatly before and after milling of the magnet raw material, so that a need to recompose the magnet composition after milling is eliminated, and thus the manufacturing processes can be simplified.

Furthermore, according to the permanent magnet of the present invention, the carbon content in the magnet powder can be reduced in advance as the magnet powder mixed with organic solvent at the wet milling in the manufacturing processes of the permanent magnet is calcined in hydrogen atmosphere before sintering. Consequently, the entirety of the magnet can be sintered densely without making a gap between a main phase and a grain boundary phase in the sintered magnet, and decline of coercive force can be avoided. Further, considerable amount of alpha iron does not separate out in the main phase of the sintered magnet and serious deterioration of magnetic properties can be avoided.

Further, according to the permanent magnet of the present invention, even if rare earth elements are combined with oxygen or carbon during a manufacturing process, the rare earth elements do not become insufficient in comparison with the stoichiometric composition, so that the formation of alpha iron in the sintered permanent magnet can be inhibited. In addition, the magnet composition does not vary greatly before and after milling of the magnet raw material, so that a need to recompose the magnet composition after milling is eliminated, and thus the manufacturing processes can be simplified.

Further, since powdery magnet particles are calcined, thermal decomposition of the organometallic compound contained can be caused more easily in the entirety of the magnet particles in comparison with the case of calcining compacted magnet particles. In other words, carbon content in the calcined body can be reduced more reliably.

According to the permanent magnet of the present invention, if Dy or Tb is used as M, the Dy or Tb having high magnetic anisotropy gets concentrated in grain boundaries of the sintered magnet. Therefore, coercive force can be improved by Dy or Tb, concentrated at the grain boundaries, preventing a reverse magnetic domain from being generated in the grain boundaries. Further, since amount of Dy or Tb added thereto is less in comparison with conventional amount thereof, decline in residual magnetic flux density can be avoided.

According to the permanent magnet of the present invention, the organometallic compound consisting of an alkyl group is used as organometallic compound to be added to magnet powder. Therefore, thermal decomposition of the organometallic compound can be caused easily when the magnet powder is calcined in hydrogen atmosphere. Consequently, carbon content in the calcined body can be reduced more reliably.

According to the permanent magnet of the present invention, the organometallic compound consisting of an alkyl group of which carbon number is any one of integer numbers 2 through 6 is used as organometallic compound to be added to magnet powder. Therefore, the organometallic compound can be thermally decomposed at low temperature when the magnet powder is calcined in hydrogen atmosphere. Consequently, thermal decomposition of the organometallic compound can be caused more easily in the entirety of the magnet powder.

According to the permanent magnet of the present invention, the residual carbon content after sintering is under 0.2 wt %. This configuration avoids occurrence of a gap between a main phase and a grain boundary phase, places the entirety of the magnet in densely-sintered state and makes it possible to avoid decline in residual magnetic flux density. Further, this configuration prevents considerable alpha iron from separating out in the main phase of the sintered magnet so that serious deterioration of magnetic properties can be avoided.

According to the manufacturing method of a permanent magnet of the present invention, magnet powder is mixed with an organic solvent at the wet milling and compacted to form a compact body, which is calcined in a hydrogen atmosphere before sintering, so that the amount of carbon contained in a magnet particle can be reduced in advance. Consequently, the entirety of the magnet can be sintered densely without making a gap between a main phase and a grain boundary phase in the sintered magnet, and decline of coercive force can be avoided. Further, considerable amount of alpha iron does not separate out in the main phase of the sintered magnet and serious deterioration of magnetic properties can be avoided.

Further, according to the manufacturing method of the permanent magnet of the present invention, even if rare earth elements are combined with oxygen or carbon during a manufacturing process, the rare earth elements do not become insufficient in comparison with the stoichiometric composition, so that the formation of alpha iron in the sintered permanent magnet can be inhibited. Further, the magnet composition before and after milling of the magnet raw material does not vary greatly, so that a need to recompose the magnet composition after milling is eliminated, and thus the manufacturing processes can be simplified.

According to the manufacturing method of a permanent magnet of the present invention, the carbon content in the magnet powder can be reduced in advance as the magnet powder mixed with an organic solvent at the wet milling in the manufacturing processes of the permanent magnet is calcined in hydrogen atmosphere before sintering. Consequently, the entirety of the magnet can be sintered densely without making a gap between a main phase and a grain boundary phase in the sintered magnet, and decline of coercive force can be avoided. Further, considerable amount of alpha iron does not separate out in the main phase of the sintered magnet and serious deterioration of magnetic properties can be avoided.

Further, according to the permanent magnet of the present invention, even if rare earth elements are combined with oxygen or carbon during a manufacturing process, the rare earth elements do not become insufficient in comparison with the stoichiometric composition, so that the formation of alpha iron in the sintered permanent magnet can be inhibited. In addition, the magnet composition does not vary greatly before and after milling of the magnet raw material, so that a need to recompose the magnet composition after milling is eliminated, and thus the manufacturing processes can be simplified.

Still further, since powdery magnet particles are calcined, thermal decomposition of the organometallic compound contained can be caused more easily in the entirety of the magnet particles in comparison with the case of calcining compacted magnet particles. In other words, carbon content in the calcined body can be reduced more reliably.

According to the manufacturing method of a permanent magnet of the present invention, the organometallic compound consisting of an alkyl group is used as organometallic compound to be added to magnet powder. Therefore, thermal decomposition of the organometallic compound can be caused easily when the magnet powder is calcined in hydrogen atmosphere. Consequently, carbon content in the calcined body can be reduced more reliably.

According to the manufacturing method of a permanent magnet of the present invention, the organometallic compound consisting of an alkyl group of which carbon number is any one of integer numbers 2 through 6 is used as organometallic compound to be added to magnet powder. Therefore, the organometallic compound can be thermally decomposed at low temperature when the magnet powder is calcined in hydrogen atmosphere. Consequently, thermal decomposition of the organometallic compound can be caused more easily in the entirety of the magnet powder.

BRIEF DESCRIPTION OF THE DRAWINGS

[FIG. 6] is a table illustrating residual carbon content in permanent magnets of embodiments 1 through 3 and comparative examples 1 through 3.

BEST MODE FOR CARRYING OUT THE INVENTION

Specific embodiments of a permanent magnet and a method for manufacturing the permanent magnet according to the present invention will be described below in detail with reference to the drawings.

[Constitution of Permanent Magnet]

Figure 1:
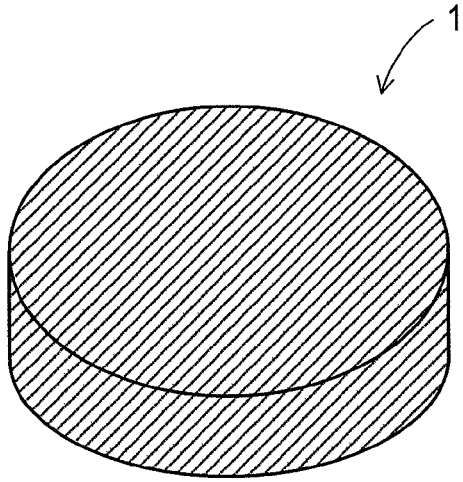
[FIG. 1] is an overall view of a permanent magnet directed to the invention.

First, a constitution of a permanent magnet 1 will be described. FIG. 1 is an overall view of the permanent magnet directed to the present invention. Incidentally, the permanent magnet 1 depicted in FIG. 1 is formed into a cylindrical shape. However, the shape of the permanent magnet 1 may be changed in accordance with the shape of a cavity used for compaction.

Figure 2:
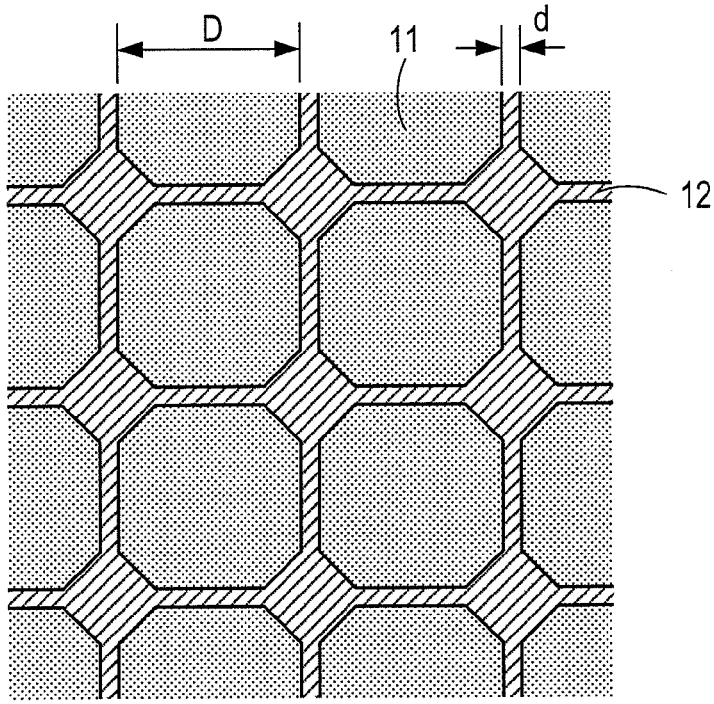
[FIG. 2] is an enlarged schematic view in vicinity of grain boundaries of the permanent magnet directed to the invention.

As the permanent magnet 1 according to the present invention, a neodymium-iron-boron (Nd—Fe—B) based magnet may be used, for example. Further, as illustrated in FIG. 2, the permanent magnet 1 is an alloy in which a main phase 11 and a metal-rich phase 12 coexist. The main phase 11 is a magnetic phase which contributes to the magnetization and the metal-rich phase 12 is a low-melting-point and non-magnetic phase where rare earth metals (rare earth elements) are concentrated (the metal-rich phase includes at least one of neodymium (Nd), praseodymium (Pr), dysprosium (Dy) and terbium (Tb), each of which is a rare earth element). FIG. 2 is an enlarged view of Nd magnet particles composing the permanent magnet 1.

Here, in the main phase 11, $Nd_2Fe_{14}B$ intermetallic compound phase (Fe here maybe partially replaced with cobalt (Co)), which is of a stoichiometric composition, accounts for high proportion in volume. Meanwhile, the metal-rich phase 12 consists of an intermetallic compound phase having higher composition ratio of rare earth elements than that of a stoichiometric composition (for example, $Nd_{2.0\text{-}3.0}Fe_{14}B$ intermetallic compound phase) . Further, the metal-rich phase 12 may include a small amount of other elements such as Co, copper (Cu), aluminum (Al), or silicon (Si) for improving magnetic property.

Then, in the permanent magnet 1, the metal-rich phase 12 has the following features. The metal-rich phase 12:

(1) has a low melting point (approx. 600 degrees Celsius) and turns into a liquid phase at sintering, contributing to densification of the magnet, which means improvement in magnetization;

(2) can eliminate surface irregularity of the grain boundaries, decreasing nucleation sites of reverse magnetic domain and enhancing coercive force; and (3) can magnetically insulate the main phase, increasing the coercive force.

Poorly dispersed metal-rich phase 12 in the sintered permanent magnet 1 potentially causes a partial sintering defect and degrade in the magnetic property; therefore it is important to have the metal-rich phase 12 uniformly dispersed in the sintered permanent magnet 1.

An example of problems likely to rise when manufacturing the Nd—Fe—B-based magnet is formation of alpha iron in a sintered alloy. This may be caused as follows: when a permanent magnet is manufactured using a magnet raw material alloy whose contents are based on the stoichiometric composition, rare earth elements therein combine with oxygen during the manufacturing process so that the amount of rare earth elements becomes insufficient in comparison with the stoichiometric composition. Here, the alpha iron has a deformability and remains in a milling apparatus without being milled. Accordingly, the alpha iron not only deteriorates the efficiency in milling the alloy, but also adversely affects the grain size distribution and composition variation before and after milling. Further, if alpha iron remains in the magnet after sintering, the magnetic property of the magnet is degraded.

It is thus desirable that the amount of all rare earth elements contained in the permanent magnet 1, including Nd and M, is within a range of 0.1 wt % through 10.0 wt % larger, or more preferably, 0.1 wt % through 5.0 wt % larger than the amount based upon the stoichiometric composition (26.7 wt %). Specifically, the contents of constituent elements are set to be Nd: 25 through 37 wt %, M: 0.1 through 10.0 wt %, B: 1 through 2 wt %, Fe (electrolytic iron): 60 through 75 wt %, respectively. By setting the contents of rare earth elements in the permanent magnet within the above range, it becomes possible to obtain the sintered permanent magnet 1 in which the metal-rich phase 12 is uniformly dispersed. Further, even if the rare earth elements are combined with oxygen during the manufacturing process, the formation of alpha iron in the sintered permanent magnet 1 can be prevented, without shortage of the rare earth elements in comparison with the stoichiometric composition.

Incidentally, if the amount of rare earth elements contained in the permanent magnet 1 is smaller than the above-described range, the metal-rich phase 12 becomes difficult to be formed. Also, the formation of alpha iron cannot sufficiently be inhibited. Meanwhile, in a case the content of rare earth elements in the permanent magnet 1 is larger than the above-described range, the increase of the coercive force becomes slow and also the residual magnetic flux density is reduced. Therefore such a case is impracticable.

Furthermore, in the present invention, the content of all rare earth elements including Nd and M in the magnet raw material at the start of milling is set to be the amount based on the above stoichiometric composition (26.7 wt %) , or larger than the amount based on the above stoichiometric composition. Then, as later described, at wet milling of the magnet material with a bead mill, there is prepared an organometallic compound containing M, expressed by $M\text{–}(OR)_x$ (in the formula, M includes at least one of Nd, Pr, Dy and Tb, each of which is a rare earth element), R represents a substituent group consisting of a straight-chain or branched-chain hydrocarbon and x represents an arbitrary integer), and the organometallic compound containing M (such as dysprosium ethoxide, dysprosium n-propoxide, terbium ethoxide) is added to a solvent and mixed with the magnet powder in a wet state. As a result, the content of all rare earth elements contained in the magnet powder after the addition of the organometallic compound becomes within a range of 0.1 wt % through 10.0 wt % larger, or more preferably, 0.1 wt % through 5.0 wt % larger than the amount based upon the stoichiometric composition (26.7 wt %). Furthermore, by being added to the solvent, the organometallic compound containing M can be dispersed in the solvent, so as to be adhered onto the particle surfaces of Nd magnet particles uniformly. Thus, the metal-rich phase 12 can be evenly dispersed in the permanent magnet 1 after sintering.

Here, metal alkoxide is one of the organometallic compounds that satisfy the above structural formula $M-(OR)_x$ (in the formula, M includes at least one of Nd, Pr, Dy and Tb, each of which is a rare earth element, R represents a substituent group consisting of a straight-chain or branched-chain hydrocarbon and x represents an arbitrary integer). The metal alkoxide is expressed by a general formula $M-(OR)_n$(M: metal element, R: organic group, n: valence of metal or metalloid). Furthermore, examples of metal or metalloid composing the metal alkoxide include Nd, Pr, Dy, Tb, W, Mo, V, Nb, Ta, Ti, Zr, Ir, Fe, Co, Ni, Cu, Zn, Cd, Al, Ga, In, Ge, Sb, Y, lanthanide and the like. However, in the present invention, Nd, Pr, Dy or Tb, each of which is a rare earth element, is specifically used.

Furthermore, the types of the alkoxide are not specifically limited, and there may be used, for instance, methoxide, ethoxide, propoxide, isopropoxide, butoxide or alkoxide the carbon number of which is 4 or larger. However, in the present invention, those of low-molecule weight are used in order to reduce the carbon residue by means of thermal decomposition at a low temperature to be later described. Furthermore, methoxide the carbon number of which is 1 is prone to decompose and difficult to deal with, therefore it is preferable to use alkoxide the carbon number of which is 2 through 6 included in R, such as ethoxide, methoxide, isopropoxide, propoxide or butoxide. That is, in the present invention, it is preferable to use, as the organometallic compound to be added to the magnet powder, an organometallic compound expressed by $M-(OR)_x$ (in the formula, M includes at least one of Nd, Pr, Dy or Tb, each being a rare earth element, R represents a straight-chain or branched-chain alkyl group and x represents an arbitrary integer) or it is more preferable to use an organometallic compound expressed by $M-(OR)_x$ (in the formula, M includes at least one of Nd, Pr, Dy or Tb, each being a rare earth element, R represents a straight-chain or branched-chain alkyl group of which carbon number is 2 through 6, and x represents an arbitrary integer).

In the present invention as has been discussed above, when a magnet raw material is wet-milled by a bead mill or the like, the content of rare earth elements is increased through adding an organometallic compound into solvent. This method is advantageous in that the magnet composition does not vary greatly before and after milling the magnet raw material in comparison with the method of increasing the content of rare earth elements contained in the magnet raw material before milling to be larger than the content based on a stoichiometric composition. Thus, there is no need to recompose the magnet composition after milling.

Furthermore, a compact body compacted through powder compaction can be sintered under appropriate sintering conditions so that M can be prevented from being diffused or penetrated (solid-solutionized) into the main phase 11. Thus, in the present invention, even if M is substituted for some Nd of the main phase 11, the area of substitution of the M can be limited within the outer shell portion. As a result, the phase of the $Nd_2Fe_{14}B$ intermetallic compound of the core accounts for the large proportion in volume, with respect to crystal grains as a whole (in other words, the sintered magnet in its entirety). Accordingly, the decrease of the residual magnetic flux density (magnetic flux density at the time when the intensity of the external magnetic field is brought to zero) can be inhibited.

Furthermore, in a case where the organometallic compound is mixed in the organic solvent and then added wet to the magnet powder, even if the organic solvent is volatilized through vacuum desiccation performed later, an organic compound such as the organometallic compound or the organic solvent still remains in the magnet. In addition, reactivity of Nd and carbon is significantly high and in case carbon-containing material remains even at a high-temperature stage in a sintering process, carbide is formed. As a result, there may rise a problem that gaps are formed between the main phase and the grain boundary phase (metal-rich phase) of the magnet after sintering due to the created carbide, making it impossible to densely sinter the entirety of the magnet, and thus significantly deteriorating the magnetic properties thereof. However, in the present invention, the carbon content in magnet particles can be reduced in advance through performing a later-described calcination process in hydrogen before sintering.

Further, it is desirable to set the crystal grain diameter of the main phase 11 to be 0.1 μm through 5.0 μm. Incidentally, the structure of the main phase 11 and the metal-rich phase 12 can be confirmed, for instance, through SEM, TEM or three-dimensional atom probe technique.

If Dy or Tb is included as M, it becomes possible to concentrate Dy or Tb in the grain boundaries of magnet particles. As a result, coercive force can be improved by Dy or Tb concentrated in the grain boundaries, inhibiting the reverse magnetic domain from forming in the grain boundaries. Further, the amount of additive Dy or Tb can be made smaller than the conventional amount, thus inhibiting the residual magnetic flux density from decreasing.

[First Method for Manufacturing Permanent Magnet]

Figure 3:
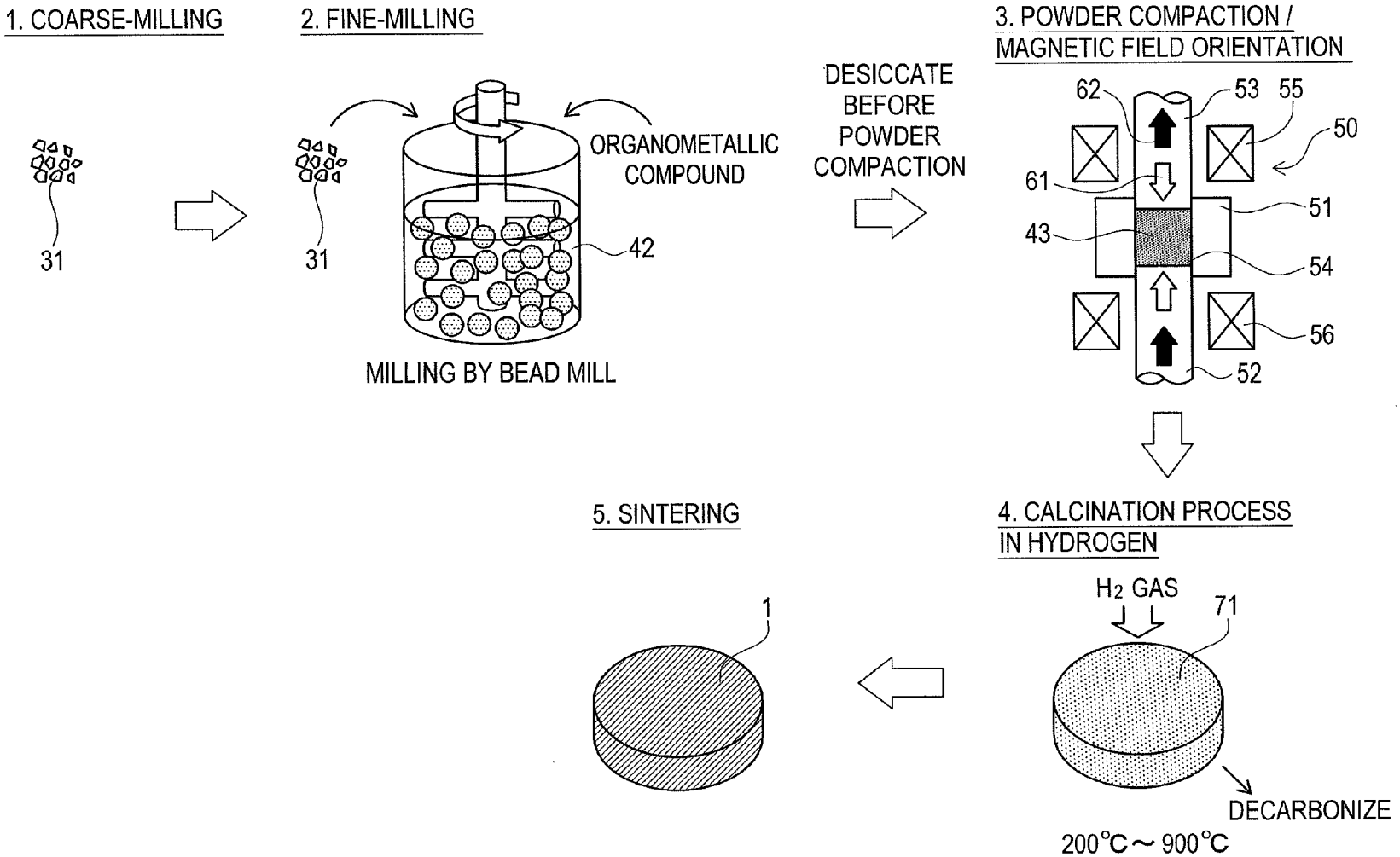
[FIG. 3] is an explanatory diagram illustrating manufacturing processes of a permanent magnet according to a first manufacturing method of the invention.

Next, the first method for manufacturing the permanent magnet 1 directed to the present invention will be described below with reference to FIG. 3. FIG. 3 is an explanatory view illustrating a manufacturing process in the first method for manufacturing the permanent magnet 1 directed to the present invention.

First, there is manufactured an ingot comprising Nd—Fe—B of certain fractions (for instance, Nd: 32.7 wt %, Fe (electrolytic iron): 65.96 wt %, and B: 1.34 wt %) . Thereafter the ingot is coarsely milled using a stamp mill, a crusher, etc. to a size of approximately 200 μm. Otherwise, the ingot is dissolved, formed into flakes using a strip-casting method, and then coarsely milled using a hydrogen pulverization method. Thus, coarsely-milled magnet powder 31 is obtained.

Then, the coarsely milled magnet powder 31 is finely milled to a predetermined particle size (for instance, 0.1 μm to 5.0 μm) by a wet method using a bead mill, and the magnet powder is dispersed in a solvent to prepare slurry 42. Incidentally, in the wet milling, 4 kg of toluene is used as solvent to 0.5 kg of the magnet powder. Further, the organometallic compound containing rare earth elements is added to the magnet powder during the wet milling, thereby dispersing the organometallic compound containing rare earth elements in the solvent together with the magnet powder. Incidentally, a desirable organometallic compound to be dissolved is an organometallic compound expressed by formula $M-(OR)_x$ (in the formula, M includes at least one of Nd, Pr, Dy and Tb, each being a rare earth element, R represents one of a straight-chain or branched alkyl group with carbon number 2-6 and x represents an arbitrary integer) (such as dysprosium ethoxide, dysprosium n-propoxide, terbium ethoxide). Further, there is no specific limit with respect to the amount of the organometallic compound containing rare earth elements to be added, however, as described above, the content of rare earth elements included in the permanent magnet is preferably in a range of 0.1 wt % to 10.0 wt % larger, or more preferably 0.1 wt % to 5.0 wt % larger than the amount based on the stoichiometric composition (26.7 wt %). Further, the organometallic compound may be added after performing the wet milling.

Incidentally, detailed dispersion conditions are as below.

Dispersing device: bead mill

Dispersing media: zirconia beads

Furthermore, the solvent used for milling is an organic solvent. However, there is no particular limitation on the types of solvent, and there can be used an alcohol such as isopropyl alcohol, ethanol or methanol, an ester such as ethyl acetate, a lower hydrocarbon such as pentane or hexane, an aromatic compound such as benzene, toluene or xylene, a ketone, a mixture thereof or the like.

Thereafter, the prepared slurry 42 is desiccated in advance through vacuum desiccation or the like before compaction and desiccated magnet powder 43 is obtained. Then, the desiccated magnet powder is subjected to powder-compaction to form a given shape using a compaction device 50. There are dry and wet methods for the powder compaction, and the dry method includes filling a cavity with the desiccated fine powder and the wet method includes filling a cavity with the slurry 42 without desiccation. In this embodiment, a case where the dry method is used is described as an example. Furthermore, the organic solvent or the organometallic compound solution can be volatilized at the sintering stage after compaction.

As illustrated in FIG. 3, the compaction device 50 has a cylindrical mold 51, a lower punch 52 and an upper punch 53, and a space surrounded therewith forms a cavity 54. The lower punch 52 slides upward/downward with respect to the mold 51, and the upper punch 53 slides upward/downward with respect to the mold 51, in a similar manner.

In the compaction device 50, a pair of magnetic field generating coils 55 and 56 is disposed in the upper and lower positions of the cavity 54 so as to apply magnetic flux to the magnet powder 43 filling the cavity 54. The magnetic field to be applied may be, for instance, 1 MA/m.

When performing the powder compaction, firstly, the cavity 54 is filled with the desiccated magnet powder 43. Thereafter, the lower punch 52 and the upper punch 53 are activated to apply pressure against the magnet powder 43 filling the cavity 54 in a pressurizing direction of arrow 61, thereby performing compaction thereof. Furthermore, simultaneously with the pressurization, pulsed magnetic field is applied to the magnet powder 43 filling the cavity 54, using the magnetic field generating coils 55 and 56, in a direction of arrow 62 which is parallel with the pressuring direction. As a result, the magnetic field is oriented in a desired direction. Incidentally, it is necessary to determine the direction in which the magnetic field is oriented while taking into consideration the magnetic field orientation required for the permanent magnet 1 formed from the magnet powder 43.

Furthermore, in a case where the wet method is used, slurry may be injected while applying the magnetic field to the cavity 54, and in the course of the injection or after termination of the injection, a magnetic field stronger than the initial magnetic field may be applied to perform the wet molding. Furthermore, the magnetic field generating coils 55 and 56 may be disposed so that the application direction of the magnetic field is perpendicular to the pressuring direction.

Secondly, the compact body 71 formed through the powder compaction is held for several hours (for instance, five hours) in hydrogen atmosphere at 200 through 900 degrees Celsius, or more preferably 400 through 900 degrees Celsius (for instance, 600 degrees Celsius), to perform a calcination process in hydrogen. The hydrogen feed rate during the calcination is 5 L/min. So-called decarbonization is performed during this calcination process in hydrogen. In the decarbonization, the remnant organic compound is thermally decomposed so that carbon content in the calcined body can be decreased. Furthermore, calcination process in hydrogen is to be performed under a condition of less than 0.2 wt % carbon content in the calcined body, or more preferably less than 0.1 wt %. Accordingly, it becomes possible to densely sinter the permanent magnet 1 in its entirety in the following sintering process, and the decrease in the residual magnetic flux density and coercive force can be prevented.

Here, $NdH_3$ exists in the compact body 71 calcined through the calcination process in hydrogen as above described, which indicates a problematic tendency to combine with oxygen. However, in the first manufacturing method, the compact body 71 after the calcination is brought to the later-described sintering without being exposed to the external air, eliminating the need for the dehydrogenation process. The hydrogen contained in the compact body is removed while being sintered.

Following the above, there is performed a sintering process for sintering the compact body 71 calcined through the calcination process in hydrogen. However, for a sintering method for the compact body 71, there can be employed, besides commonly-used vacuum sintering, pressure sintering in which the compact body 71 is sintered in a pressured state. For instance, when the sintering is performed in the vacuum sintering, the temperature is risen to approximately 800 through 1080 degrees Celsius in a given rate of temperature increase and held for approximately two hours. During this period, the vacuum sintering is performed, and the degree of vacuum is preferably equal to or smaller than $10^{-4}$ Torr. The compact body 71 is then cooled down, and again undergoes a heat treatment in 600 through 1000 degrees Celsius for two hours. As a result of the sintering, the permanent magnet 1 is manufactured.

Meanwhile, the pressure sintering includes, for instance, hot pressing, hot isostatic pressing (HIP), high pressure synthesis, gas pressure sintering, and spark plasma sintering (SPS) and the like. However, it is preferable to adopt the spark plasma sintering which is uniaxial pressure sintering in which pressure is uniaxially applied and also in which sintering is performed by electric current sintering, so as to prevent grain growth of the magnet particles during the sintering and also to prevent warpage formed in the sintered magnets. Incidentally, the following are the preferable conditions when the sintering is performed in the SPS; pressure is applied at 30 MPa, the temperature is risen in a rate of 10 degrees Celsius per minute until reaching 940 degrees Celsius in vacuum atmosphere of several Pa or lower and then the state of 940 degrees Celsius in vacuum atmosphere is held for approximately five minutes. The compact body 71 is then cooled down, and again undergoes a heat treatment in 600 through 1000 degrees Celsius for two hours. As a result of the sintering, the permanent magnet 1 is manufactured.

[Second Method for Manufacturing Permanent Magnet]

Figure 4:
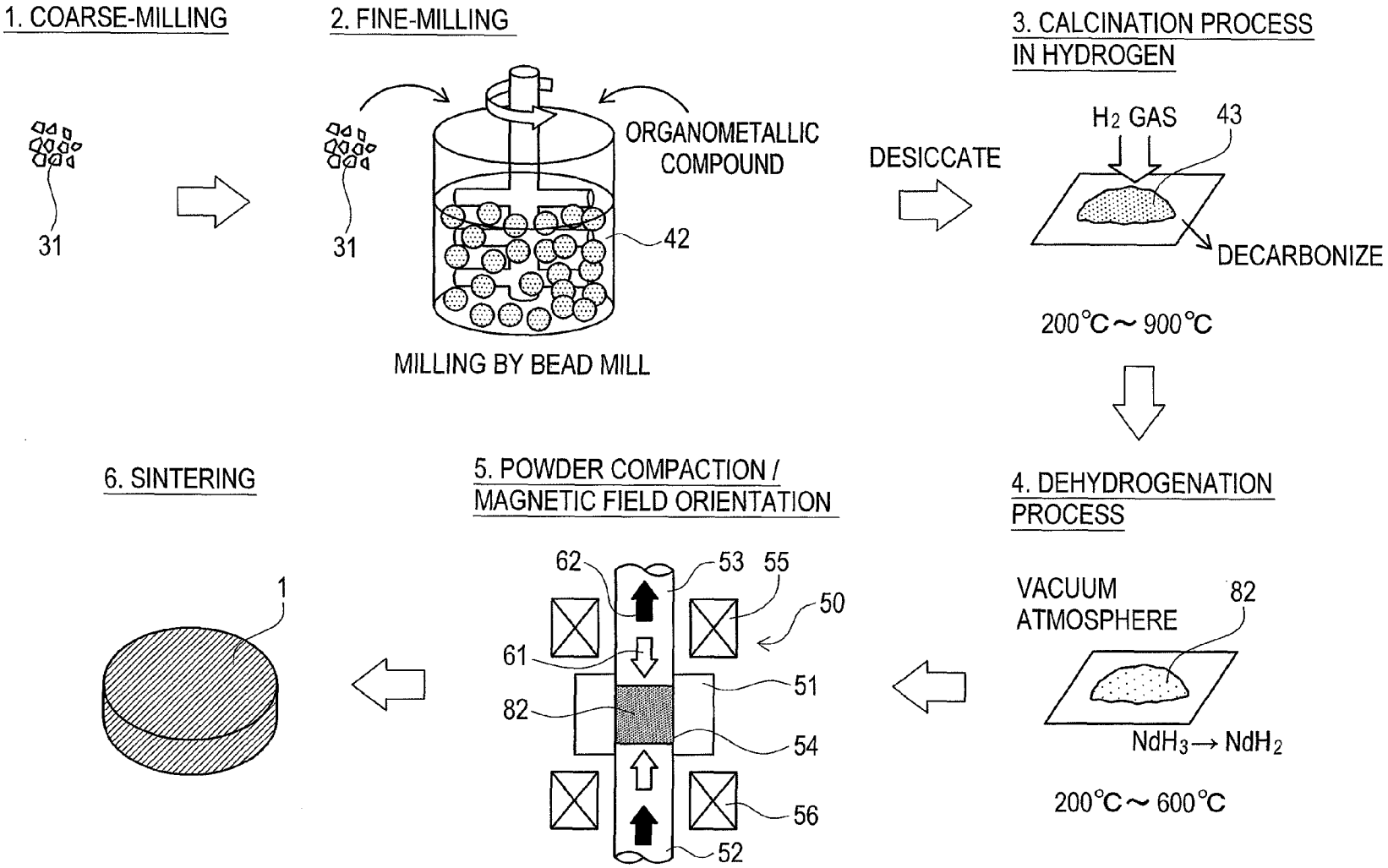
[FIG. 4] is an explanatory diagram illustrating manufacturing processes of a permanent magnet according to a second manufacturing method of the invention.

Next, the second method for manufacturing the permanent magnet 1 which is an alternative manufacturing method will be described below with reference to FIG. 4. FIG. 4 is an explanatory view illustrating a manufacturing process in the second method for manufacturing the permanent magnet 1 directed to the present invention.

The process until the slurry 42 is manufactured is the same as the manufacturing process in the first manufacturing method already discussed referring to FIG. 3, therefore detailed explanation thereof is omitted.

Firstly, the prepared slurry 42 is desiccated in advance through vacuum desiccation or the like before compaction and desiccated magnet powder 43 is obtained. Then, the desiccated magnet powder 43 is held for several hours (for instance, five hours) in hydrogen atmosphere at 200 through 900 degrees Celsius, or more preferably 400 through 900 degrees Celsius (for instance, 600 degrees Celsius), for a calcination process in hydrogen. The hydrogen feed rate during the calcination is 5 L/min. So-called decarbonization is performed in this calcination process in hydrogen. In the decarbonization, the organometallic material is thermally decomposed so that carbon content in the calcined body can be decreased. Furthermore, calcination process in hydrogen is to be performed under a condition of less than 0.2 wt % carbon content in the calcined body, or more preferably less than 0.1 wt %. Accordingly, it becomes possible to densely sinter the permanent magnet 1 in its entirety in the following sintering process, and the decrease in the residual magnetic flux density and coercive force can be prevented.

Secondly, the powdery calcined body 82 calcined through the calcination process in hydrogen is held for one through three hours in vacuum atmosphere at 200 through 600 degrees Celsius, or more preferably 400 through 600 degrees Celsius for a dehydrogenation process. Incidentally, the degree of vacuum is preferably equal to or smaller than 0.1 Torr.

Here, $NdH_3$ exists in the calcined body 82 calcined through the calcination process in hydrogen as above described, which indicates a problematic tendency to combine with oxygen.

Figure 5:
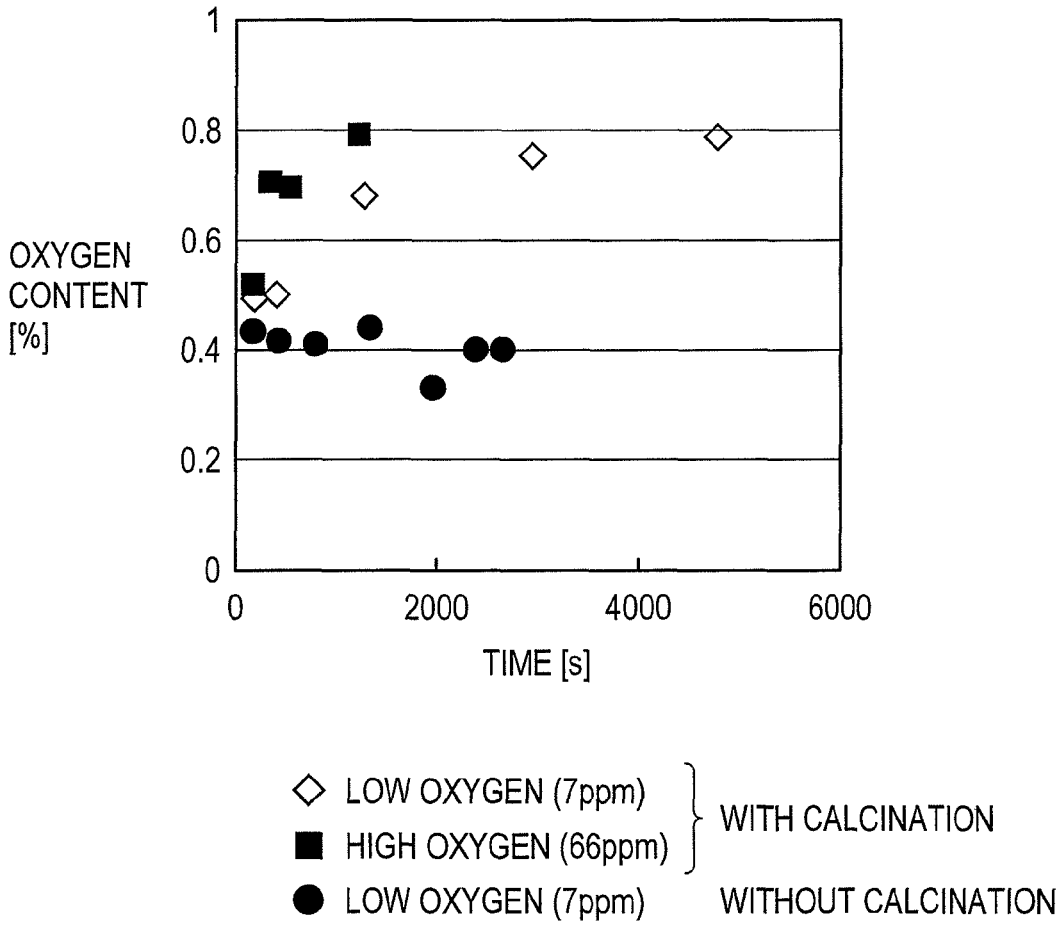
[FIG. 5] is a diagram illustrating changes of oxygen content with and without a calcination process in hydrogen.

FIG. 5 is a diagram depicting oxygen content of magnet powder with respect to exposure duration, when Nd magnet powder with a calcination process in hydrogen and Nd magnet powder without a calcination process in hydrogen are exposed to each of the atmosphere with oxygen concentration of 7 ppm and the atmosphere with oxygen concentration of 66 ppm. As illustrated in FIG. 5, when the Nd magnet powder with the calcination process in hydrogen is exposed to the atmosphere with high-oxygen concentration of 66 ppm, the oxygen content of the magnet powder increases from 0.4% to 0.8% in approximately 1000 sec. Even when the Nd magnet powder with the calcination process is exposed to the atmosphere with low-oxygen concentration of 7 ppm, the oxygen content of the magnet powder still increases from 0.4% to the similar amount 0.8%, in approximately 5000 sec. Oxygen combined with Nd causes the decrease in the residual magnetic flux density and in the coercive force.

Therefore, in the above dehydrogenation process, $NdH_3$ (having high activity level) in the calcined body 82 created at the calcination process in hydrogen is gradually changed: from $NdH_3$ (having high activity level) to $NdH_2$ (having low activity level). As a result, the activity level is decreased with respect to the calcined body 82 activated by the calcination process in hydrogen. Accordingly, if the calcined body 82 calcined at the calcination process in hydrogen is later moved into the external air, Nd therein is prevented from combining with oxygen, and the decrease in the residual magnetic flux density and coercive force can also be prevented.

Then, the powdery calcined body 82 after the dehydrogenation process undergoes the powder compaction to be compressed into a given shape using the compaction device 50. Details are omitted with respect to the compaction device 50 because the manufacturing process here is similar to that of the first manufacturing method already described referring to FIG. 3.

Then, there is performed a sintering process for sintering the compacted-state calcined body 82. The sintering process is performed by the vacuum sintering or the pressure sintering similar to the above first manufacturing method. Details of the sintering condition are omitted because the manufacturing process here is similar to that of the first manufacturing method already described. As a result of the sintering, the permanent magnet 1 is manufactured.

However, the second manufacturing method discussed above has an advantage that the calcination process in hydrogen is performed to the powdery magnet particles, therefore the thermal decomposition of the remnant organic compound can be more easily caused to the entirety of magnet particles, in comparison with the first manufacturing method in which the calcination process in hydrogen is performed to the compacted magnet particles. That is, it becomes possible to securely decrease the carbon content of the calcined body, in comparison with the first manufacturing method.

However, in the first manufacturing method, the compact body 71 after calcined in hydrogen is brought to the sintering without being exposed to the external air, eliminating the need for the dehydrogenation process. Accordingly, the manufacturing process can be simplified in comparison with the second manufacturing method. However, also in the second manufacturing method, in a case where the sintering is performed without any exposure to the external air after calcined in hydrogen, the dehydrogenation process becomes unnecessary.

Embodiments

Here will be described embodiments according to the present invention referring to comparative examples for comparison.

(Embodiment 1)

In comparison with fraction regarding alloy composition of a neodymium magnet according to the stoichiometric composition (Nd: 26.7 wt %, Fe (electrolytic iron): 72.3 wt %, B: 1.0 wt %), proportion of Nd in that of the neodymium magnet powder for the embodiment 1 is set higher, such as Nd/Fe/B=32.7/65.96/1.34 in wt %, for instance. Further, 5 wt % of dysprosium n-propoxide has been added as organometallic compound to be added to the solvent in the milling at a bead mill. Further, toluene is used as organic solvent for wet milling. A calcination process has been performed by holding the magnet powder before compaction for five hours in hydrogen atmosphere at 600 degrees Celsius. The hydrogen feed rate during the calcination is 5 L/min. Sintering of the compacted-state calcined body has been performed in the SPS. Other processes are the same as the processes in [Second Method for Manufacturing Permanent Magnet] mentioned above.

(Embodiment 2)

Terbium ethoxide has been used as organometallic compound to be added. Other conditions are the same as the conditions in embodiment 1.

(Embodiment 3)

Dysprosium ethoxide has been used as organometallic compound to be added. Other conditions are the same as the conditions in embodiment 1.

(Embodiment 4)

Sintering of a compacted-state calcined body has been performed in the vacuum sintering instead of the SPS. Other conditions are the same as the conditions in embodiment 1.

(Comparative Example 1)

Dysprosium n-propoxide has been used as organometallic compound to be added, and sintering has been performed without undergoing a calcination process in hydrogen. Other conditions are the same as the conditions in embodiment 1.

(Comparative Example 2)

Terbium ethoxide has been used as organometallic compound to be added, and sintering has been performed without undergoing a calcination process in hydrogen. Other conditions are the same as the conditions in embodiment 1.

(Comparative Example 3)

Dysprosium acetylacetonate has been used as organometallic compound to be added. Other conditions are the same as the conditions in embodiment 1.

(Comparative Example 4)

A calcination process has been performed in helium atmosphere instead of hydrogen atmosphere. Further, sintering of a compacted-state calcined body has been performed in the vacuum sintering instead of the SPS. Other conditions are the same as the conditions in embodiment 1.

(Comparative Example 5)

A calcination process has been performed in vacuum atmosphere instead of hydrogen atmosphere. Further, sintering of a compacted-state calcined body has been performed in the vacuum sintering instead of the SPS. Other conditions are the same as the conditions in embodiment 1.

Comparison of Embodiments with Comparative Examples Regarding Residual Carbon Content The table of FIG. 6 shows residual carbon content [wt %] in each permanent magnet according to embodiments 1 through 3 and comparative examples 1 through 3.

As shown in FIG. 6, the carbon content remaining in the magnet particles can be significantly reduced in embodiments 1 through 3 in comparison with comparative examples 1 through 3. Specifically, the carbon content remaining in the magnet particles can be made less than 0.2 wt % in each of embodiments 1 through 3.

Further, in comparison between the embodiments 1, 3 and the comparative examples 1, 2, respectively, despite addition of the same organometallic compound, they have got significant difference with respect to carbon content in magnet particles depending on with or without calcination process in hydrogen; the cases with the calcination process in hydrogen can reduce carbon content more significantly than the cases without. In other words, through the calcination process in hydrogen, there can be performed a so-called decarbonization in which the organic compound is thermally decomposed so that carbon content in the calcined body can be decreased. As a result, it becomes possible to densely sinter the entirety of the magnet and to prevent the coercive force from degradation.

In comparison between the embodiments 1 through 3 and comparative example 3, carbon content in the magnet powder can be more significantly decreased in the case of adding an organometallic compound represented as $M-(OR)_x$ (in the formula, M includes at least one of Nd, Pr, Dy and Tb, each being a rare earth element, R represents a substituent group consisting of a straight-chain or branched-chain hydrocarbon and x represents an arbitrary integer), than the case of adding other organometallic compound. In other words, decarbonization can be easily caused during the calcination process in hydrogen by using an organometallic compound represented as $M-(OR)_x$ (in the formula, M includes at least one of Nd, Pr, Dy and Tb, each being a rare earth element, R represents a substituent group consisting of a straight-chain or branched-chain hydrocarbon and x represents an arbitrary integer) as additive. As a result, it becomes possible to densely sinter the entirety of the magnet and to prevent the coercive force from degradation. Further, it is preferable to use as organometallic compound to be added an organometallic compound consisting of an alkyl group, more preferably organometallic compound consisting of an alkyl group of which carbon number is any one of integer numbers 2 through 6, which enables the organometallic compound to thermally decompose at a low temperature when calcining the magnet powder in hydrogen atmosphere. Thereby, thermal decomposition of the organometallic compound can be more easily performed over the entirety of the magnet particles.

(Result of Surface Analysis with XMA Carried Out for Permanent Magnets)

Figure 7:
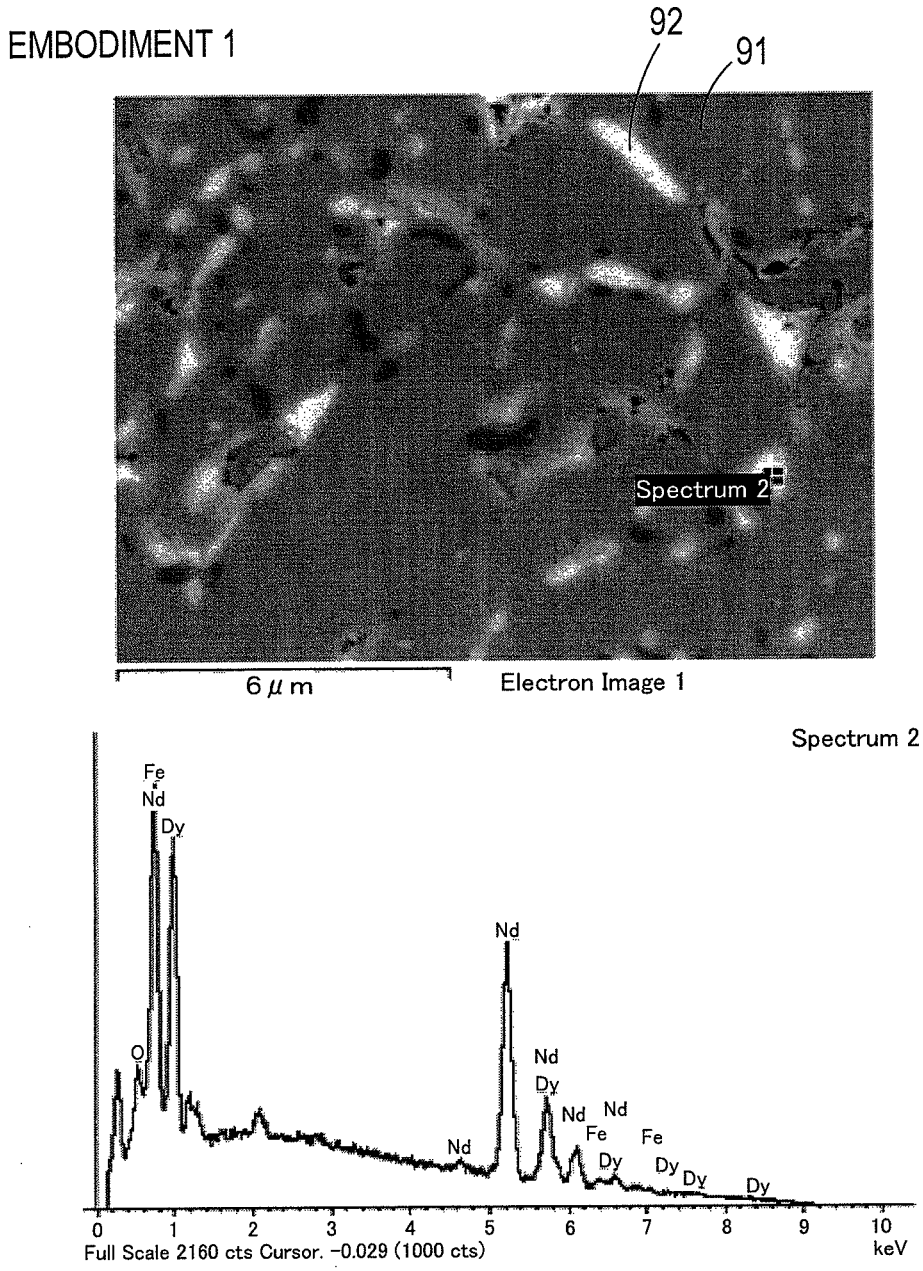
[FIG. 7] is an SEM image and an element analysis result on a grain boundary phase of the permanent magnet of the embodiment 1 after sintering.
Figure 8:
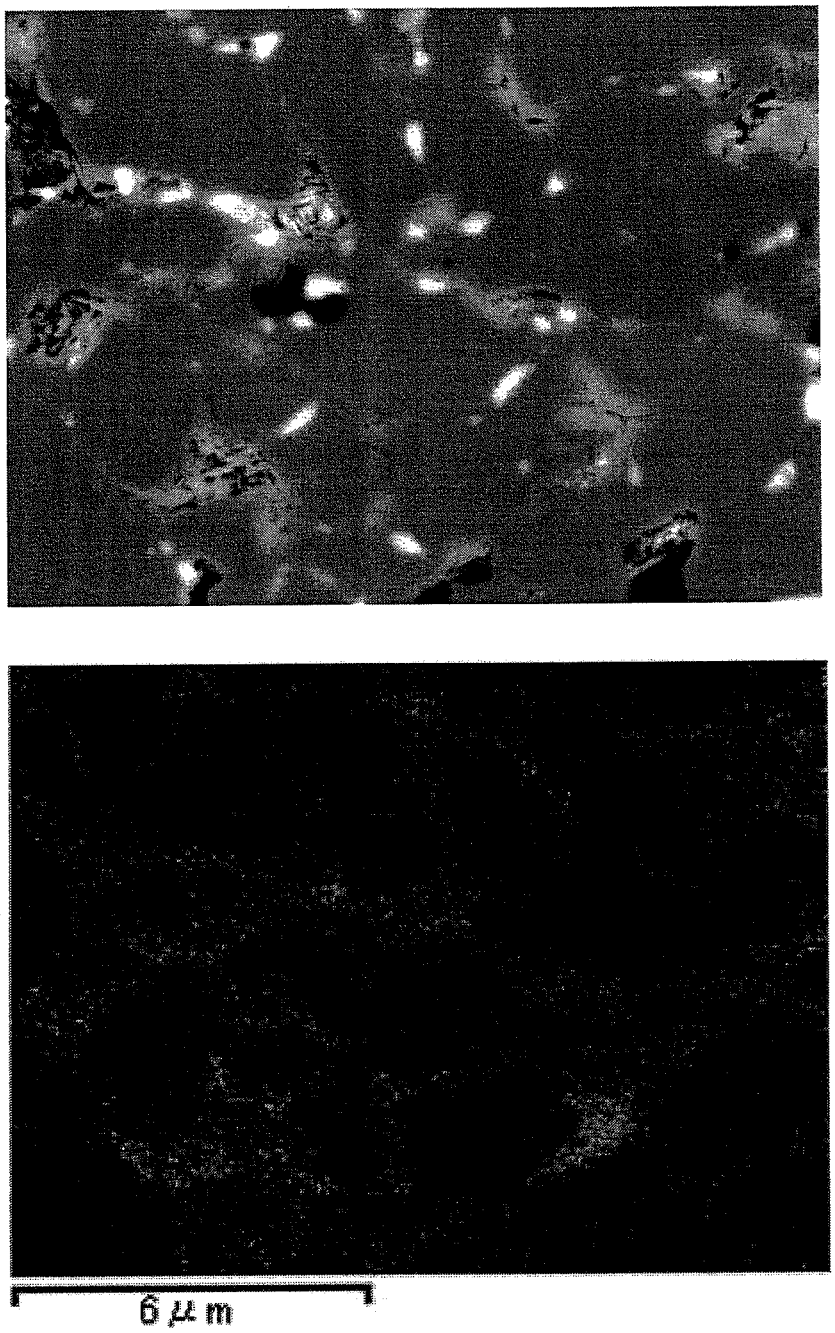
[FIG. 8] is an SEM image and mapping of a distribution state of Dy element in the same visual field with the SEM image of the permanent magnet of the embodiment 1 after sintering.
Figure 9:
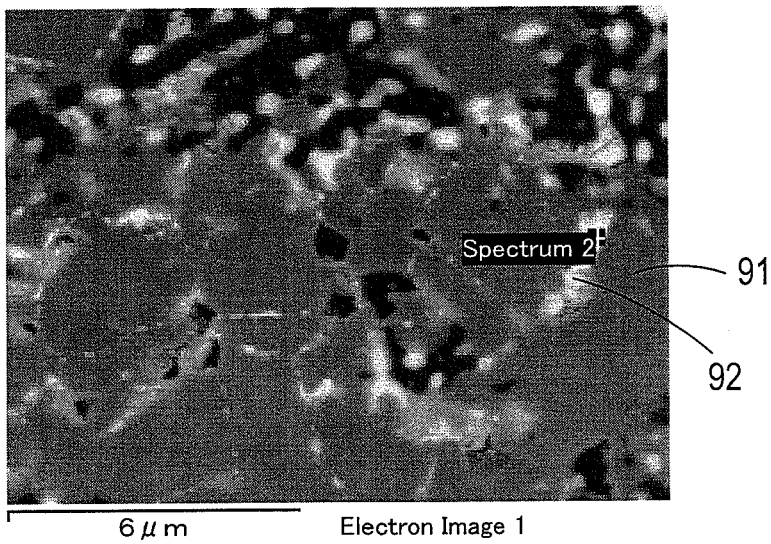
[FIG. 9] is an SEM image and an element analysis result on a grain boundary phase of the permanent magnet of the embodiment 2 after sintering.
Figure 9:
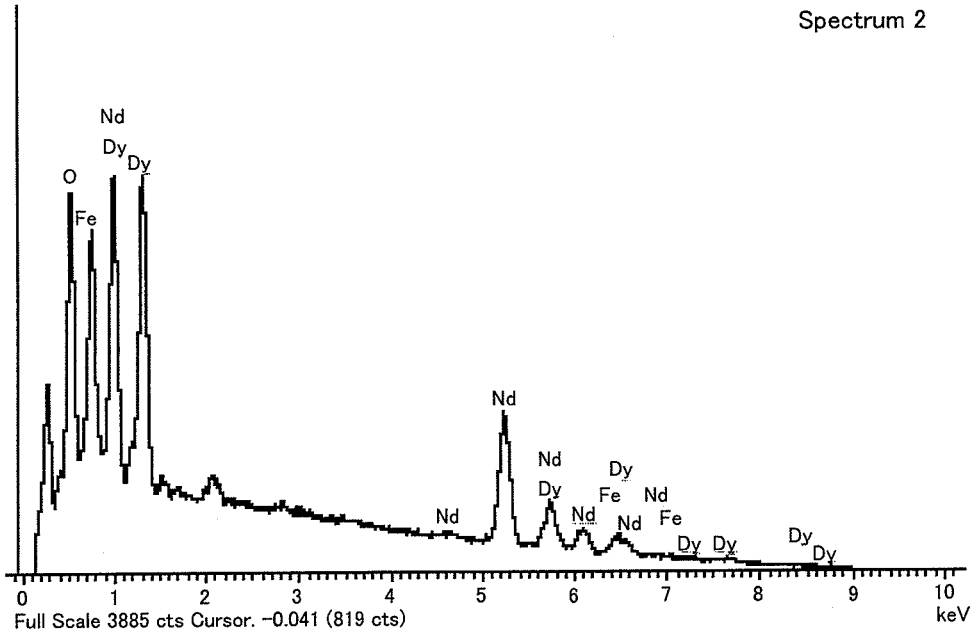
Figure 10:
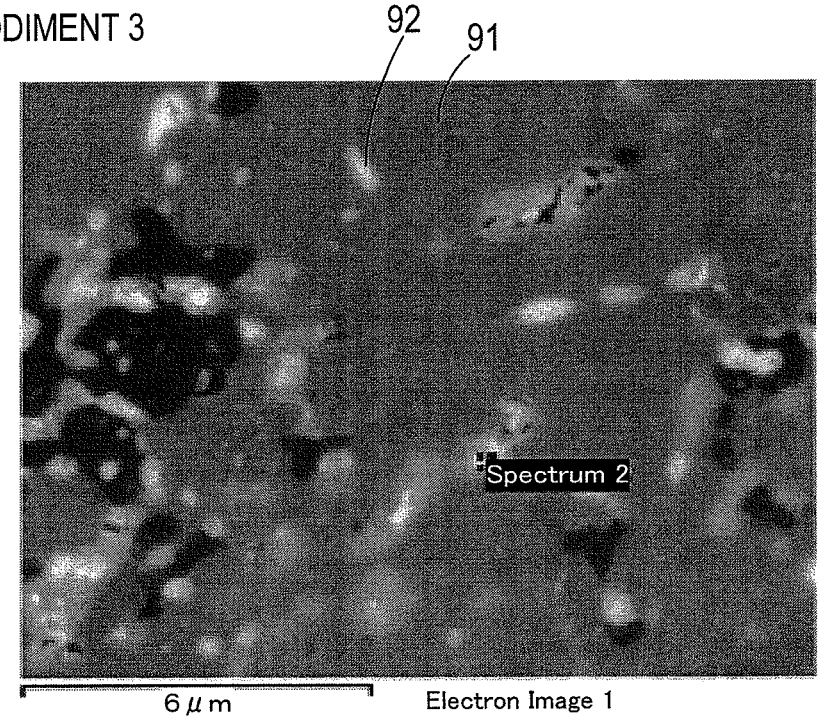
[FIG. 10] is an SEM image and an element analysis result on a grain boundary phase of the permanent magnet of the embodiment 3 after sintering.
Figure 10:
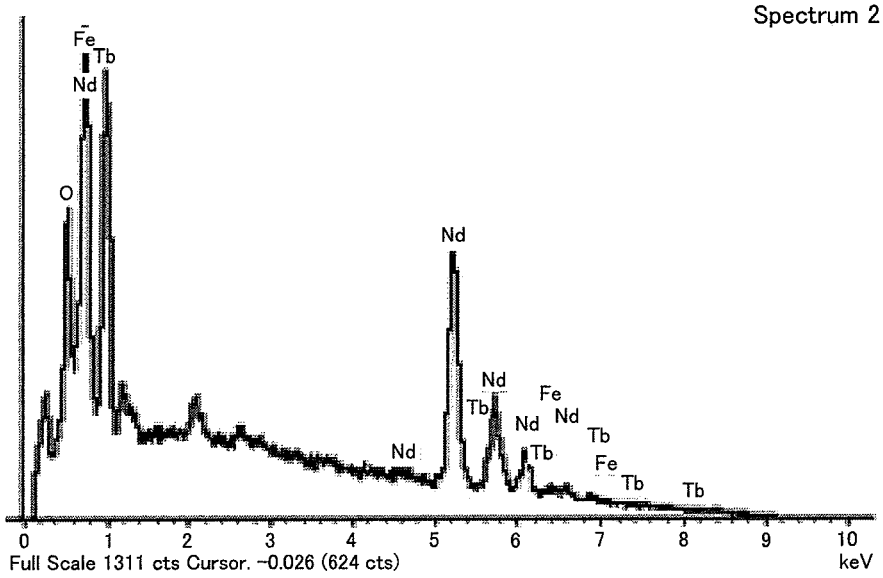
Figure 11:
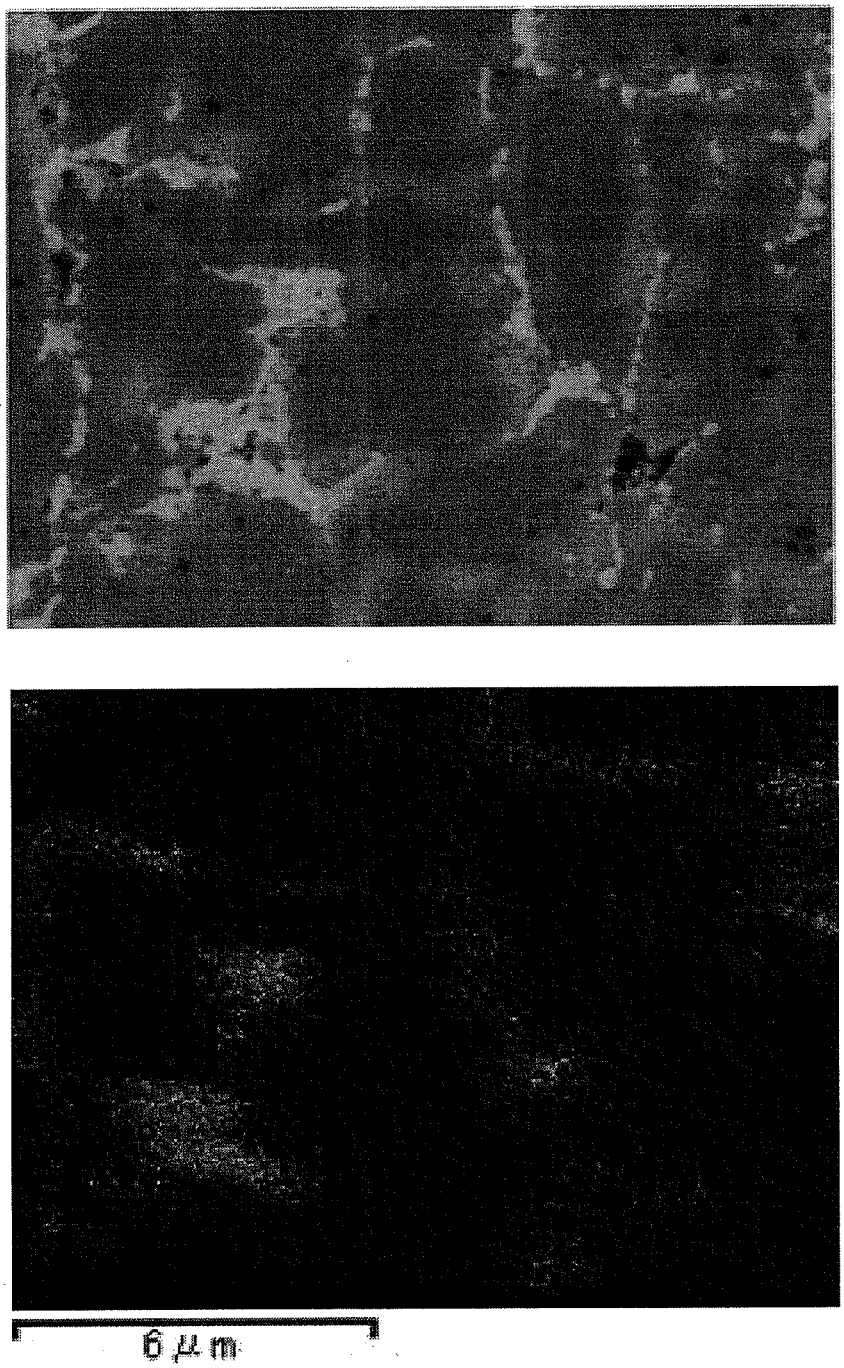
[FIG. 11] is an SEM image and mapping of a distribution state of Tb element in the same visual field with the SEM image of the permanent magnet of the embodiment 3 after sintering.

Surface analysis with an XMA (X-ray micro analyzer) has been carried out for each of permanent magnets directed to the embodiments 1 through 3. FIG. 7 is an SEM image and an element analysis result on a grain boundary phase of the permanent magnet of the embodiment 1 after sintering. FIG. 8 is an SEM image and mapping of a distribution state of Dy element in the same visual field with the SEM image of the permanent magnet of the embodiment 1 after sintering. FIG. 9 is an SEM image and an element analysis result on a grain boundary phase of the permanent magnet of the embodiment 2 after sintering. FIG. 10 is an SEM image and an element analysis result on a grain boundary phase of the permanent magnet directed to the embodiment 3 after sintering. FIG. 11 is an SEM image and mapping of a distribution state of Tb element in the same visual field with the SEM image of the permanent magnet of the embodiment 3 after sintering.

As shown in FIG. 7, FIG. 9 and FIG. 10, Dy as oxide or non-oxide is detected in the grain boundary phase of each of the permanent magnets of the embodiments 1, 2 and 3. That is, in each of the permanent magnets directed to the embodiments 1, 2 and 3, it is observed that Dy disperses from a grain boundary phase to a main phase and a phase where Dy substitutes for a part of Nd is formed on surfaces of main phase (outer shell).

In the mapping of FIG. 8, white portions represent distribution of Dy element. The set of the SEM image and the mapping in FIG. 8 explains that white portions (i.e., Dy element) are concentrated at the perimeter of a main phase. That is, in the permanent magnet of the embodiment 1, Dy is concentrated at the grain boundaries thereof. On the other hand, in the mapping of FIG. 11, white portions represent distribution of Tb element. The set of the SEM image and the mapping in FIG. 11 explains that white portions (i.e., Tb element) are concentrated at the perimeter of a main phase. That is, in the permanent magnet of the embodiment 3, Tb is concentrated at the grain boundaries thereof.

The above results indicate that, in the embodiments 1 through 3, Dy or Tb can be concentrated in grain boundaries of the magnet.

Comparative Review with SEM Images of Embodiments and Comparative Examples

Figure 12:
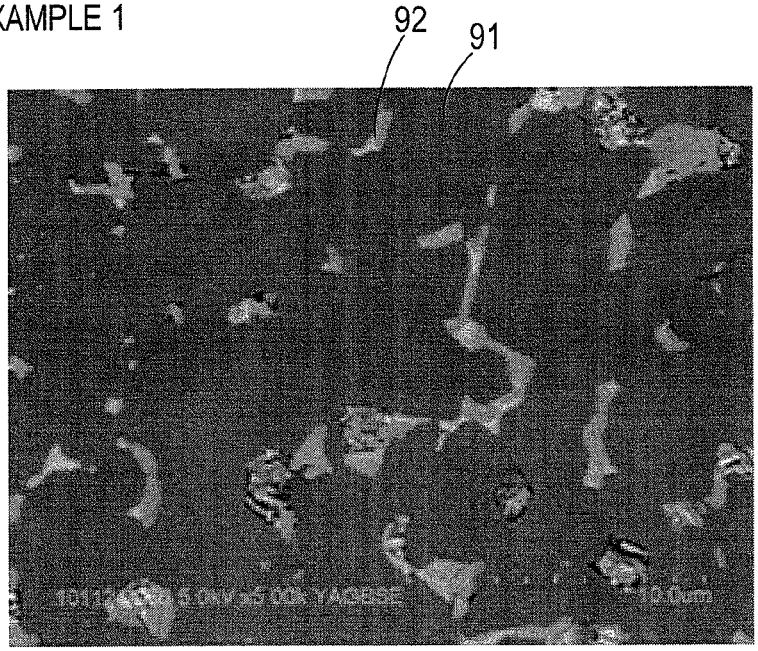
[FIG. 12] is an SEM image of the permanent magnet of the comparative example 1 after sintering.
Figure 13:
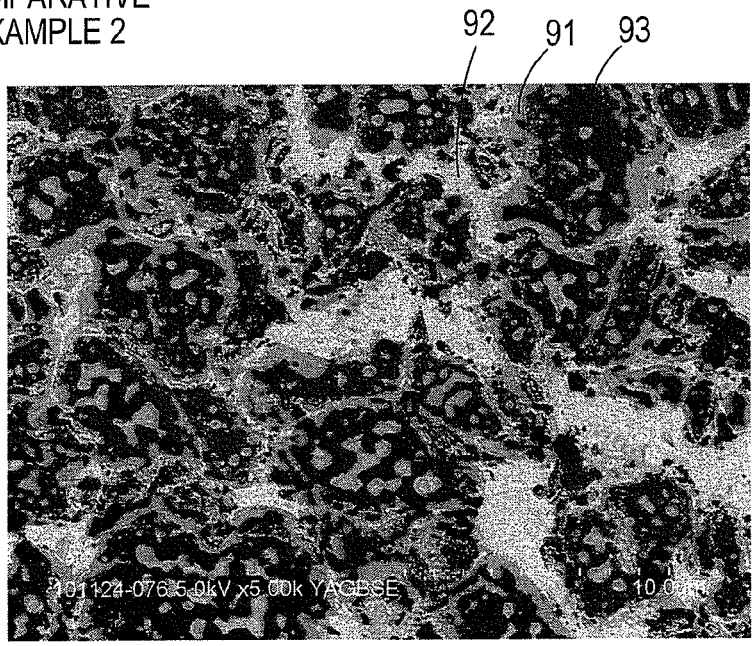
[FIG. 13] is an SEM image of the permanent magnet of the comparative example 2 after sintering.
Figure 14:
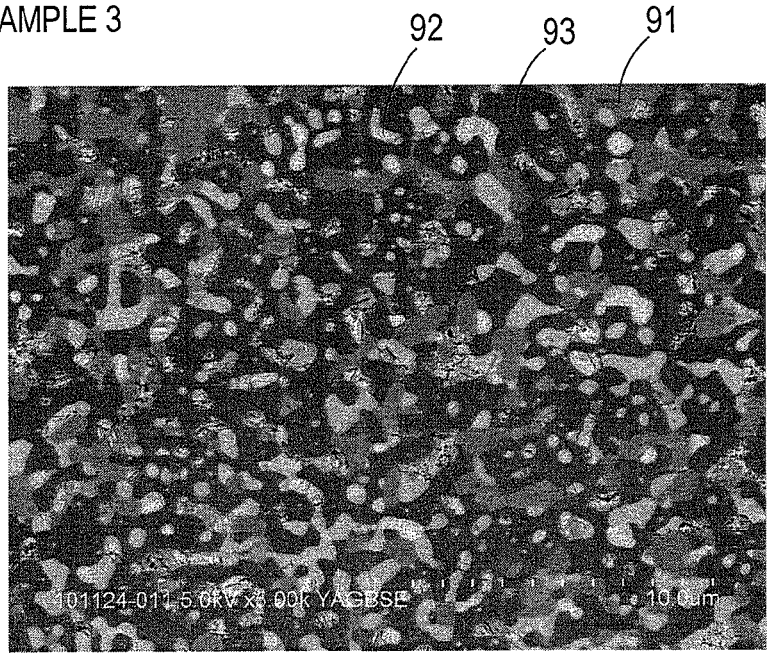
[FIG. 14] is an SEM image of the permanent magnet of the comparative example 3 after sintering.

FIG. 12 is an SEM image of the permanent magnet of the comparative example 1 after sintering. FIG. 13 is an SEM image of the permanent magnet of the comparative example 2 after sintering. FIG. 14 is an SEM image of the permanent magnet of the comparative example 3 after sintering.

Comparison will be made with the SEM images of the embodiments 1 through 3 and those of comparative examples 1 through 3. With respect to the embodiments 1 through 3 and the comparative example 1 in which residual carbon content is equal to specific amount or lower (e.g., 0.2 wt % or lower), there can be commonly observed formation of a sintered permanent magnet basically constituted by a main phase of neodymium magnet ($Nd_2Fe_{14}B$) 91 and a grain boundary phase 92 that looks like white speckles. Also, a small amount of alpha iron phase is formed there. On the other hand, with respect to the comparative examples 2 and 3 in which residual carbon content is larger in comparison with the embodiments 1 through 3 and the comparative example 1, there can be commonly observed formation of considerable number of alpha iron phases 93 that look like black belts in addition to a main phase 91 and a grain boundary phase 92. It is to be noted that alpha iron is generated due to carbide that remains at the time of sintering. That is, reactivity of Nd and carbon is significantly high and in case carbon-containing material remains in the organic compound even at a high-temperature stage in a sintering process like the comparative examples 2 and 3, carbide is formed. Consequently, the thus formed carbide causes alpha iron to separate out in a main phase of a sintered magnet and magnetic properties are considerably degraded.

On the other hand, as described in the above, the embodiments 1 through 3 each use proper organometallic compound and perform calcination process in hydrogen so that the organic compound is thermally decomposed and carbon contained therein can be burned off previously (i.e., carbon content can be reduced). Especially, by setting calcination temperature to a range between 200 and 900 degrees Celsius, more preferably to a range between 400 and 900 degrees Celsius, carbon contained therein can be burned off more than required and carbon content remaining in the magnet after sintering can be restricted to the extent of less than 0.2 wt %, more preferably, less than 0.1 wt %. In the embodiments 1 through 3 where carbon content remaining in the magnet is less than 0.2 wt % , little carbide is formed in a sintering process, which avoids the problem such like the appearance of the considerable number of alpha iron phases 93 that can be observed in the comparative examples 2 and 3. Consequently, as shown in FIG. 7 through FIG. 11, the entirety of the respective permanent magnet 1 can be sintered densely through the sintering process. Further, considerable amount of alpha iron does not separate out in a main phase of the sintered magnet so that serious degradation of magnetic properties can be avoided. Still further, Dy or Tb only can be concentrated in grain boundaries in a selective manner, Dy or Tb contributing to improvement of coercive force. Thus, the present invention intends to reduce the carbon residue by means of thermal decomposition at a low temperature. Therefore, in view of the intention, as to-be-added organometallic compound, it is preferable to use a low molecular weight compound (e.g., the one consisting of an alkyl group of which carbon number is anyone of integer numbers 2 through 6).

Figure 15:
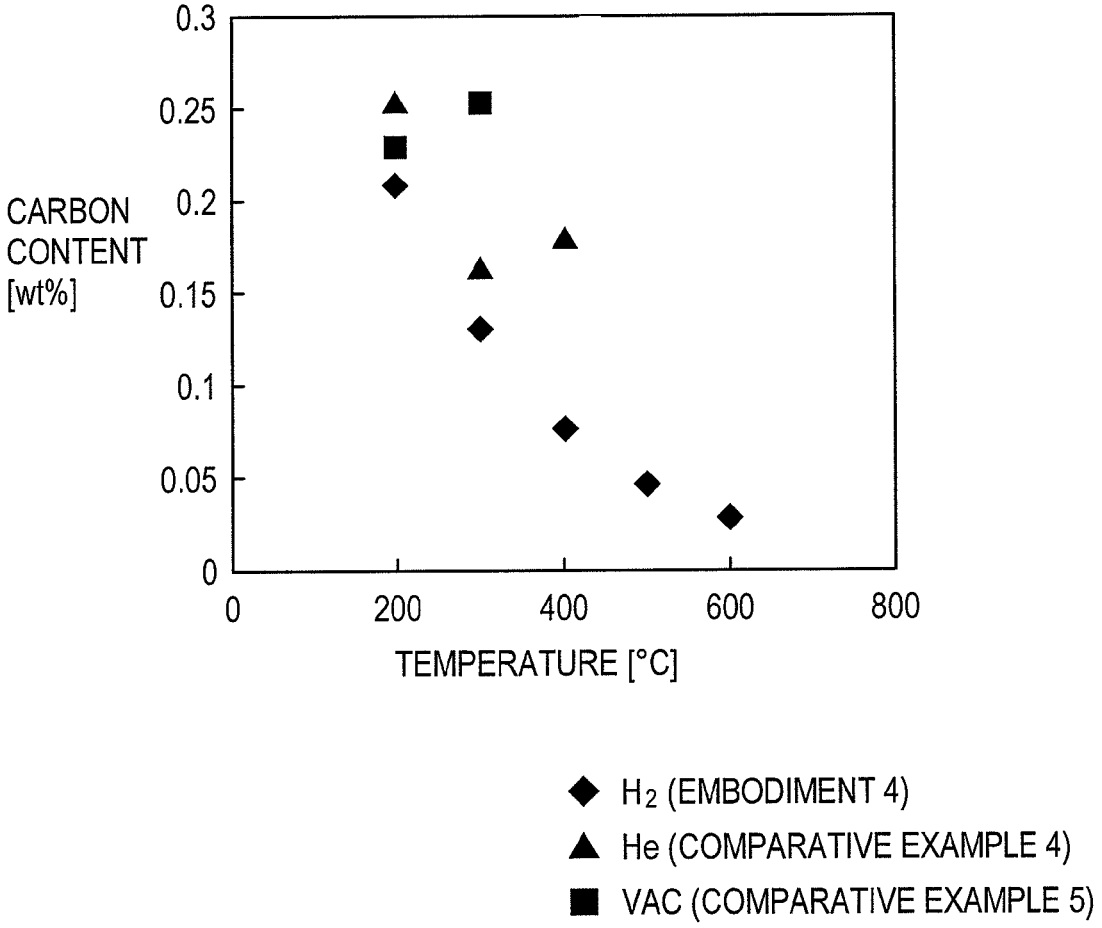
[FIG. 15] is a diagram of carbon content in a plurality of permanent magnets manufactured under different conditions of calcination temperature with respect to permanent magnets of embodiment 4 and comparative examples 4 and 5.

Comparative Review of Embodiments and Comparative Examples Based on Conditions of Calcination Process in Hydrogen FIG. 15 is a diagram of carbon content [wt %] in a plurality of permanent magnets manufactured under different conditions of calcination temperature with respect to permanent magnets of embodiment 4 and comparative examples 4 and 5. It is to be noted that FIG. 15 shows results obtained on condition feed rate of hydrogen and that of helium are similarly set to 1 L/min and held for three hours.

It is apparent from FIG. 15 that, in case of calcination in hydrogen atmosphere, carbon content in magnet particles can be reduced more significantly in comparison with cases of calcination in helium atmosphere and vacuum atmosphere. It is also apparent from FIG. 15 that carbon content in magnet particles can be reduced more significantly as calcination temperature in hydrogen atmosphere is set higher. Especially, by setting the calcination temperature to a range between 400 and 900 degrees Celsius, carbon content can be reduced less than 0.2 wt %.

Incidentally, if a permanent magnet is manufactured through wet-bead-milling without additive alkoxide and sintered without hydrogen calcination, the remnant carbon in the permanent magnet is measured at 12000 ppm, in a case toluene is used as solvent, and 31000 ppm in a case cyclohexane is used. Meanwhile, with hydrogen calcination, the remnant carbon can be reduced to approximately 300 ppm in either case of toluene or cyclohexane.

In the above embodiments 1 through 4 and comparative examples 1 through 5, permanent magnets manufactured in accordance with [Second Method for Manufacturing Permanent Magnet] have been used. Similar results can be obtained in case of using permanent magnets manufactured in accordance with [First Method for Manufacturing Permanent Magnet].

As described in the above, with respect to the permanent magnet 1 and the manufacturing method of the permanent magnet 1 directed to the above embodiments, coarsely-milled magnet powder is further milled in a solvent by a bead mill together with an organometallic compound expressed with a structural formula of $M-(OR)_x$ (M includes at least one of Nd, Pr, Dy and Tb, each being a rare earth element, R represents a substituent group consisting of a straight-chain or branched-chain hydrocarbon and x represents an arbitrary integer), so as to uniformly adhere the organometallic compound to particle surfaces of the magnet powder. Thereafter, a compact body formed through powder compaction of the magnet powder is held for several hours in hydrogen atmosphere at 200 through 900 degrees Celsius for a calcination process in hydrogen. Thereafter, through vacuum sintering or pressure sintering, the permanent magnet 1 is manufactured. Accordingly, even if the magnet material is milled wet using an organic solvent, the remnant organic compound can be thermally decomposed and carbon contained therein can be burned off before sintering (i.e., carbon content can be reduced). Therefore, little carbide is formed in a sintering process. Consequently, the entirety of the magnet can be sintered densely without making a gap between a main phase and a grain boundary phase in the sintered magnet and decline of coercive force can be avoided. Further, considerable amount of alpha iron does not separate out in the main phase of the sintered magnet and serious deterioration of magnetic properties can be avoided.

Still further, as typical organometallic compound to be added to magnet powder, it is preferable to use an organometallic compound consisting of an alkyl group, more preferably an alkyl group of which carbon number is any one of integer numbers 2 through 6. By using such configured organometallic compound, the organometallic compound can be thermally decomposed easily at a low temperature when the magnet powder or the compact body is calcined in hydrogen atmosphere. Thereby, the organometallic compound in the entirety of the magnet powder or the compact body can be thermally decomposed more easily.

Still further, in the process of calcining the magnet powder of the compact body, the compact body is held for predetermined length of time within a temperature range between 200 and 900 degrees Celsius, more preferably, between 400 and 900 degrees Celsius. Therefore, carbon contained therein can be burned off more than required.

As a result, carbon content remaining after sintering is less than 0.2 wt %, more preferably, less than 0.1 wt %. Thereby, the entirety of the magnet can be sintered densely without occurrence of a gap between a main phase and a grain boundary phase and decline in residual magnetic flux density can be avoided. Further, this configuration prevents considerable alpha iron from separating out in the main phase of the sintered magnet so that serious deterioration of magnetic characters can be avoided.

Further, at wet milling at a bead mill, an organometallic compound expressed with a structural formula of $M-(OR)_x$ (M includes at least one of Nd, Pr, Dy and Tb each of which is a rare earth element, R represents a substituent group consisting of a straight-chain or branched-chain hydrocarbon and x represents an arbitrary integer) is added in a wet state, so as to uniformly adhere the organometallic compound to particle surfaces of the magnet powder. The calcination and the sintering are performed thereafter, making it possible to inhibit alpha iron to separate out in the permanent magnet after sintering, without insufficiency of rare earth elements with respect to the stoichiometric composition even if the rare earth elements are combined with oxygen or carbon in manufacturing processes. Further, the magnet composition is not greatly varied before and after milling, and accordingly, the magnet composition needs not to be recomposed and the manufacturing processes can be simplified.

In the second manufacturing method, calcination process is performed to the powdery magnet particles, therefore the thermal decomposition of the remnant organic compound can be more easily performed to the entirety of magnet particles in comparison with a case of calcining compacted magnet particles. That is, it becomes possible to reliably decrease the carbon content of the calcined body. By performing dehydrogenation process after calcination process, activity level is decreased with respect to the calcined body activated by the calcination process. Thereby, the resultant magnet particles are prevented from combining with oxygen and the decrease in the residual magnetic flux density and coercive force can also be prevented.

Not to mention, the present invention is not limited to the above-described embodiment but may be variously improved and modified without departing from the scope of the present invention.

Further, of magnet powder, milling condition, mixing condition, calcination condition, dehydrogenation condition, sintering condition, etc. are not restricted to conditions described in the embodiments.

Further, the dehydrogenation process may be omitted.

Incidentally, in the embodiments, a wet bead mill is used as a means for wet-milling the magnet powder; however, other wet-milling methods may be used. For instance, Nanomizer (trade name of a wet-type media-less atomization device manufactured by Nanomizer, Inc.) may be used.

Further, in the embodiments 1 through 4, dysprosium n-propoxide, dysprosium ethoxide or terbium ethoxide is used as Dy-or-Tb-inclusive organometallic compound that is to be added to magnet powder. Other organometallic compounds may be used as long as being an organometallic compound that satisfies a formula of $M-(OR)_x$ (M includes at least one of Nd, Pr, Dy and Tb, each of which is a rare earth element, R represents a substituent group consisting of a straight-chain or branched-chain hydrocarbon, and x represents an arbitrary integer). For instance, there may be used an organometallic compound of which carbon number is 7 or larger and an organometallic compound including a substituent group consisting of carbon hydride other than an alkyl group.

EXPLANATION OF REFERENCES

1 permanent magnet
11 main phase
12 metal-rich phase
91 main phase
92 grain boundary phase
93 alpha iron phase

The invention claimed is:

1. A manufacturing method of a permanent magnet comprising steps of wet-milling magnet material in an organic solvent to obtain magnet powder;

adding, to the organic solvent during the wet-milling, an organometallic compound expressed with a structural formula of $$M-(OR)_x,$$

M including at least one of neodymium, praseodymium, dysprosium and terbium, each being a rare earth element, R representing a substituent group consisting of a straight-chain or branched-chain hydrocarbon, and x representing an arbitrary integer, to make the organometallic compound adhered to particle surfaces of the magnet powder in the organic solvent to obtain a slurry-state magnet powder;

injecting the slurry-state magnet powder containing the organic solvent used in the wet-milling into a cavity without drying the slurry-state magnet powder, while applying an initial magnetic field to the cavity, and further applying a magnetic field stronger than the initial magnetic field to the cavity during or after the injection so as to perform wet molding and obtain a compact body in which the organometallic compound is adhered to the particle surfaces of the magnet powder;

calcining the compact body in hydrogen atmosphere so as to obtain a calcined body of which carbon residue is reduced in comparison with before calcining the compact body, wherein the step of calcining causes thermal decomposition of the organometallic compound and removes R so as to reduce carbon residue; and sintering the calcined body.

2. The manufacturing method of a permanent magnet according to claim 1, wherein R in the structural formula is an alkyl group.

3. The manufacturing method of a permanent magnet according to claim 2, wherein R in the structural formula is an alkyl group of which carbon number is any one of integer numbers 2 through 6.

* * * * *